US006102808A

United States Patent [19]

Wong

[11] Patent Number: 6,102,808

[45] Date of Patent: Aug. 15, 2000

[54] HEIGHT-ADJUSTABLE BILLIARD TABLE

[75] Inventor: Hong-Mou Wong, Taipei, Taiwan

[73] Assignee: Wan Chao Wood Industrial Co., Ltd., Chia-Yi Hsien, Taiwan

[21] Appl. No.: 09/208,467

[22] Filed: Dec. 10, 1998

[51] Int. Cl.[7] ..... A47C 17/62

[52] U.S. Cl. ..... 473/12; 473/160; 473/4; 473/11; 108/144.11

[58] Field of Search ..... 473/11, 12, 15, 473/33, 45, 48, 50, 160; 108/144.11, 50.01, 7; 248/188.1, 188.8

[56] References Cited

U.S. PATENT DOCUMENTS

| | | | |
|---|---|---|---|
| 1,736,316 | 11/1929 | Lasting | 473/160 |
| 2,334,540 | 11/1943 | Buffham | 473/160 |
| 3,170,694 | 2/1965 | Dolce | 473/160 |
| 4,615,279 | 10/1986 | De La Haye | 108/144 |
| 4,711,184 | 12/1987 | Wallin et al. | 108/144 |
| 5,241,914 | 9/1993 | Korb | 108/7 |

*Primary Examiner*—Jeannete Chapman
*Assistant Examiner*—Mitra Aryanpour
*Attorney, Agent, or Firm*—A & J

[57] ABSTRACT

A height-adjustable billiard table includes a table body and legs. The table body has a bottom portion. Securing plates are disposed at four corners of the bottom portion and have respective support screw rods secured thereto. Each support screw rod has a gear in the form of an umbrella disposed at a top end thereof. The legs have screw rod seats at top ends thereof for receiving the support screw rods that connect the securing plates to the top ends of the legs. A transmission shaft having opposed worms provided at two opposite ends thereof is disposed at the bottom portion of the table body to extend in a longitudinal direction. Two worm shafts are disposed at front and rear ends of the bottom portion of the table body. The worm shafts are transverse to the transmission shaft and parallel to each other. Each worm shaft engages the respective one of the worms on the transmission shaft by means of worm gears, and has two gears in the form of an umbrella mounted at both ends thereof to engage the corresponding gears on the support screw rods. When the transmission shaft rotates, it drives the support screw rods synchronously to achieve synchronous and level adjustment of the height of the table body to suit users of different heights.

1 Claim, 3 Drawing Sheets

HEIGHT-ADJUSTABLE BILLIARD TABLE

BACKGROUND OF THE INVENTION

1. Field of the Invention

The present invention relates generally to a height-adjustable billiard table, and more particularly to a billiard table in which worm gears and worms are synchronously driven via a transmission shaft to drive screw rods synchronously to thereby achieve adjustment of the height of a table body as supported by the legs thereof.

2. Description of the Prior Art

A conventional billiard table is mainly comprised of a level table body and legs supporting the table body. Bottom ends of the legs are provided with leg mounting frames adapted for correcting the level of the table body. After correction, the height of the billiard table becomes fixed and it is not adjustable whether upwardly or downwardly. If adjustment of the level of the table body is desired, the leg mounting frames at the bottom ends of the legs have to be adjusted one by one, which is very inconvenient.

SUMMARY OF THE INVENTION

The present invention relates generally to a height-adjustable billiard table, and more particularly to a billiard table in which worm gears and worms are synchronously driven via a transmission shaft to drive screw rods synchronously to thereby achieve adjustment of the height of a table body as supported by the legs thereof.

A primary object of the present invention is to provide a height-adjustable billiard table, which allows quick adjustment of the height of the billiard table depending on the user's needs.

Another object of the present invention is to provide a height-adjustable billiard table, in which a table body is caused to displace upwardly and downwardly in a level position to achieve easy height adjustment of the billiard table.

In the billiard table according to the present invention, screw rods are disposed on top ends of the legs of the billiard table to support the bottom portion of a table body, the bottom portion of the table body being provided with gears in the form of umbrellas driven synchronously by worm gears and worms engageable with gears in the form of umbrellas provided on the top ends of the screw rods. The worms are respectively disposed at both ends of a transmission shaft, which is rotated to achieve adjustment of the height of the table body.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

DETAILED DESCRIPTION OF THE PREFERRED EMBODIMENT

Figure 1:
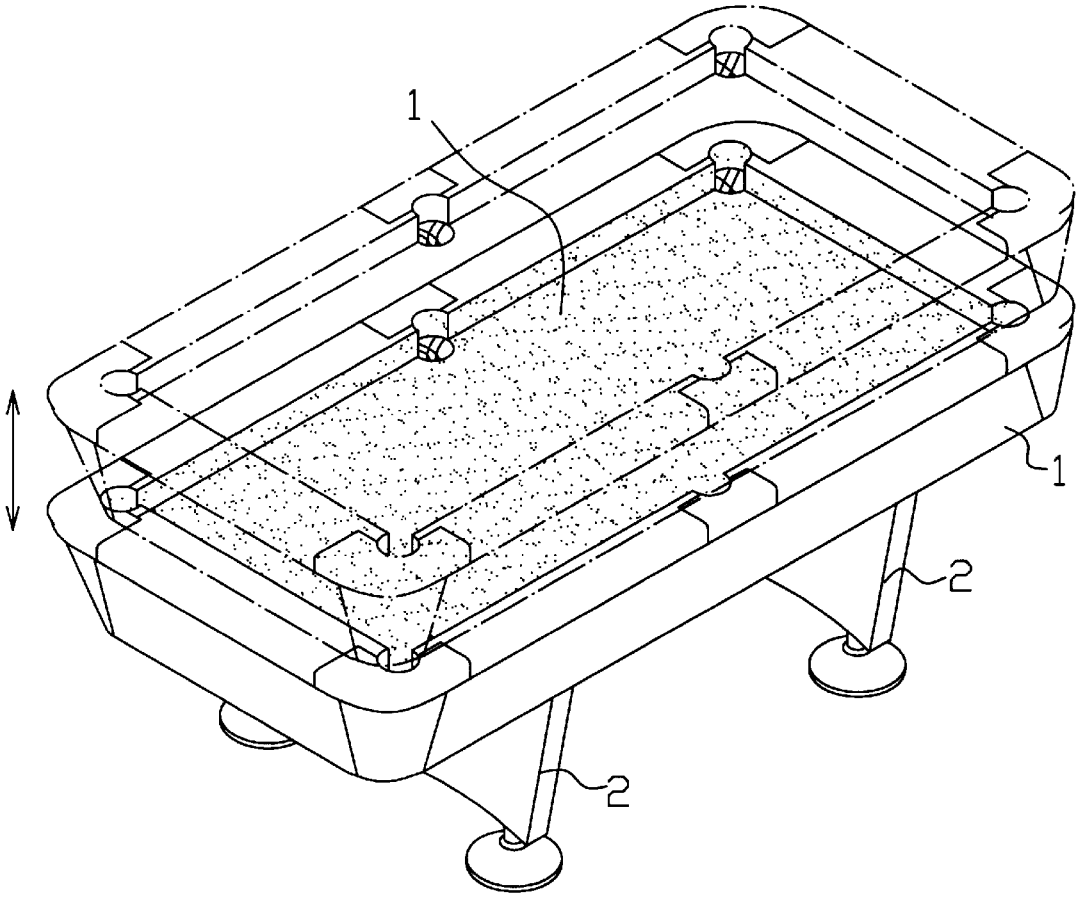
FIG. 1 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
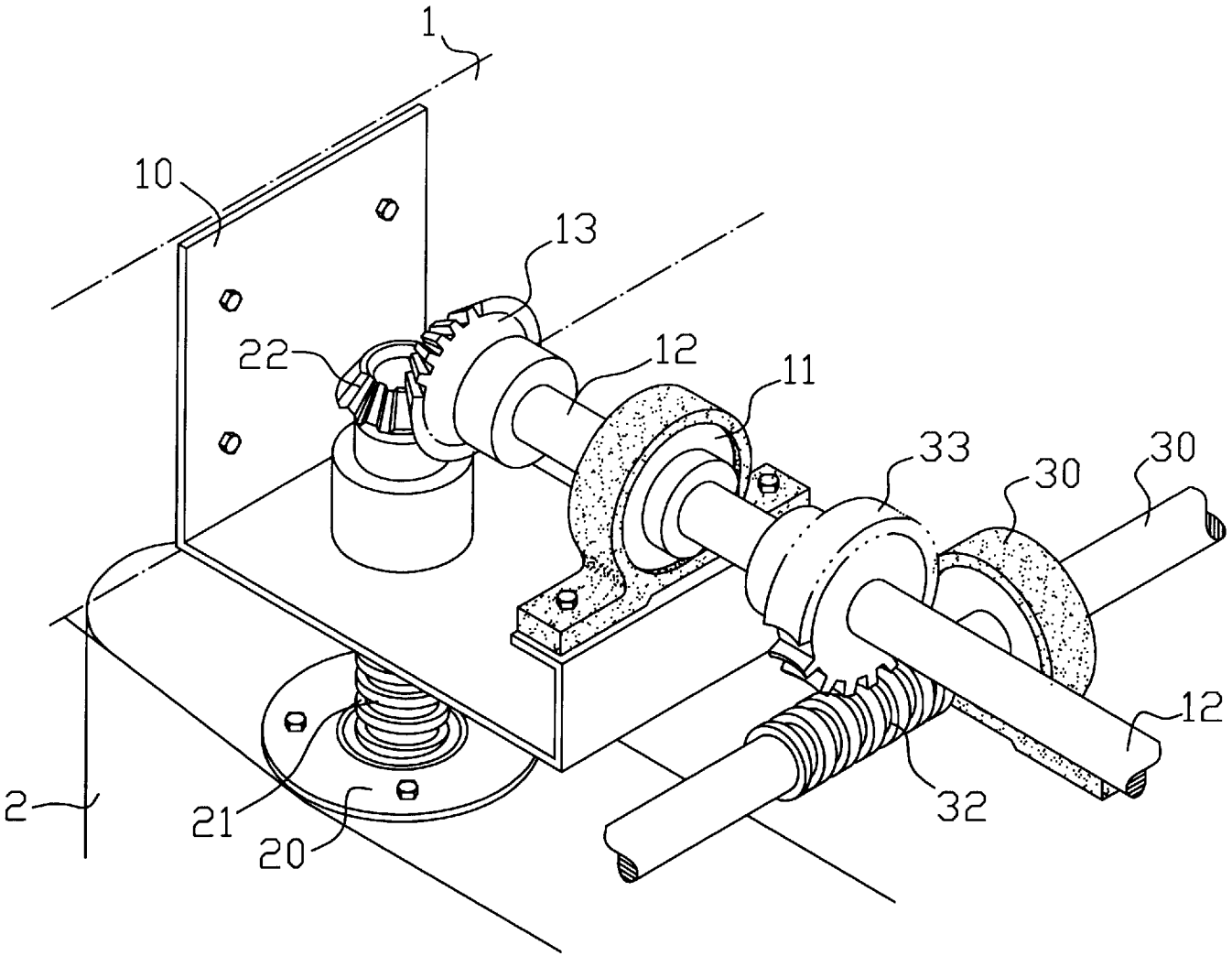
FIG. 2 is a perspective schematic view of an adjusting device according to the present invention.
Figure 3:
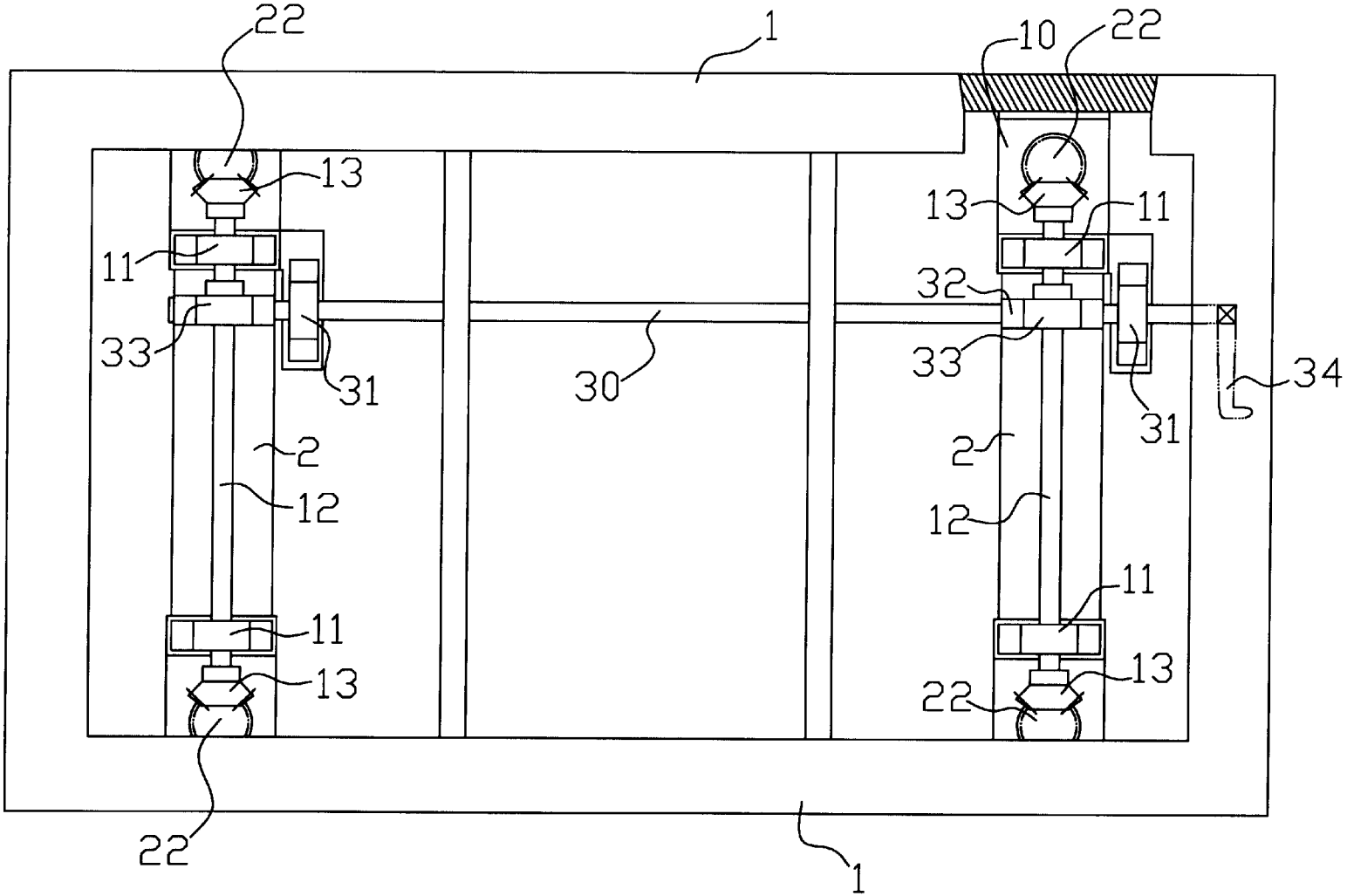
FIG. 3 is a plan schematic view of the adjusting device according to the present invention.

With reference to FIG. 1, the present invention aims to provide a billiard table having a table body 1 secured and supported by legs 2, and the height of the table body 1 is adjustable in a horizontal manner so as to adapt to different users. As shown in FIG. 1, the table body 1 is supported by front and rear legs 2 near front and rear ends of the table body 1. Referring to FIGS. 2 and 3, an adjusting device according to the present invention includes two opposed securing seats 31 disposed at a bottom portion of the table body 1 and mounted above the front and rear legs 2, and a transmission shaft 30 secured between the opposed securing seats 31 and extending longitudinally across the bottom portion of the table body 1. One end of the transmission shaft 30 may be configured to project from one end of the bottom portion of the table body 1 to be fitted with a handle 34. Worms 32 are respectively provided on both ends of the transmission shaft 30 above the corresponding front and rear legs 2.

Two pairs of opposed securing plates 10 are provided on the bottom portion of the table body 1 above the front legs 2 and the rear legs 2 respectively. In each pair of opposed securing plates 10, each securing plate 10 has a securing seat 11 provided thereon, and a worm shaft 12 is mounted between the opposed securing seats 11 transverse to the transmission shaft 30. A worm gear 33 is provided on each worm shaft 12 for engaging the respective one of the worms 32 on opposite ends of the transmission shaft 30. Each end of the worm shaft 12 is provided with a gear 13 in the shape of an umbrella.

In addition, each securing plate 10 has a support screw rod 21 secured thereon to engage a screw rod seat 20 of the respective legs 2. The screw rod seat 21 has a gear 22 in the shape of an umbrella disposed thereon to engage a respective one of the gears 13 at both ends of the worm shaft 12. The support screw rods 21 support the bottom portion of the table body 1.

As shown in FIG. 2, on both sides of front and rear legs at the bottom portion of the table body 1 at the four corners thereof, the securing plates 10 are secured to the top sides of the legs 2 by means of the support screw rods 21 received in the screw rod seats 20 disposed on the top sides of the legs 20, so that the table body 1 is supported and secured by the support screw rods 21 at the four corners thereof. Furthermore, by means of the worms 32 on the transmission shaft 30 that engage the worm gears 33 of the two worm shafts 12 disposed transverse to the transmission shaft 30, and by means of the gears 13 that are disposed at both ends of each worm shaft 12 and that engage the gears 22 at top ends of the support screw rods 21, the handle 34 at the projecting end of the transmission shaft 30 can be turned to cause the worms 32 to drive synchronously the worm shafts 12 above the front and rear legs 2, thereby driving synchronously the support screw rods 21 at the four corners of the bottom portion of the table body. Due to the above-described arrangement, the table body 1 can be adjusted to displace upwardly and downwardly to a height suitable for the user while maintaining the level of the table body 1.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A height-adjustable billiard table comprising:

a table body having a bottom portion, securing plates disposed at four corners of said bottom portion and having respective support screw rods secured thereto, each of said support screw rods each having a beveled gear disposed at a top end thereof; and four legs having screw rod seats at top ends thereof for receiving said support screw rods to connect said securing plates to said top ends of said legs, said support screw rods supporting said table body;

a transmission shaft having opposed worms provided at two opposite ends thereof being disposed at said bottom portion of said table body to extend in a longitudinal direction, one end of said transmission shaft projecting from said bottom portion of said table body for connection with a handle; and two worm shafts being disposed at front and rear ends of said table body at said bottom portion, said worm shafts being transverse to said transmission shaft and being parallel to each other, said worm shafts respectively engaging said worms on both ends of said transmission shaft by means of worm gears, each of said worm shafts having two beveled gears mounted at both ends thereof respectively to engage said gears on top ends of said support screw rods disposed at the four corners of said table body at said bottom portion;

whereby rotation of said transmission shaft drives said support screw rods to achieve synchronous and level adjustment of the height of said table body to suit users of different heights.

* * * * *